United States Patent [19]

Shikasho

[11] 4,371,315

[45] Feb. 1, 1983

[54] PRESSURE BOOSTER SYSTEM WITH LOW-FLOW SHUT-DOWN CONTROL

[75] Inventor: Satoru Shikasho, Chicago, Ill.

[73] Assignee: International Telephone and Telegraph Corporation, New York, N.Y.

[21] Appl. No.: 183,461

[22] Filed: Sep. 2, 1980

[51] Int. Cl.[3] ..... F04B 49/00; F04B 49/02

[52] U.S. Cl. ..... 417/5; 417/12; 417/32

[58] Field of Search ..... 417/2–7, 417/12, 32

[56] References Cited

U.S. PATENT DOCUMENTS

| | | | |
|---|---|---|---|
| 2,424,344 | 7/1947 | Veinott | 417/32 |
| 3,135,282 | 6/1964 | Gray | 417/4 |
| 3,232,519 | 2/1966 | Long | 417/32 |
| 3,775,025 | 11/1973 | Maher | 417/7 |
| 4,257,395 | 3/1981 | Wieder | 417/32 |

FOREIGN PATENT DOCUMENTS

| | | | |
|---|---|---|---|
| 74242 | 1/1980 | Japan | 417/32 |

*Primary Examiner*—William L. Freeh

*Attorney, Agent, or Firm*—James B. Raden; Donald J. Lenkszus

[57] ABSTRACT

An improved pressure booster system includes a control circuit which senses the temperature at the inlet and outlet of the system and shuts-down a booster pump when the temperature differential between the inlet and outlet exceeds a predetermined level.

13 Claims, 3 Drawing Figures

PRESSURE BOOSTER SYSTEM WITH LOW-FLOW SHUT-DOWN CONTROL

BACKGROUND OF THE INVENTION

This invention relates to water-pressure booster systems in general, and to an improved low-flow shut-down control arrangement for water-pressure booster systems, in particular.

Water pressure booster systems receive water from a main conduit under a normally relatively low inlet pressure and raise the water pressure to a desired level by operating one or more pumps in relation to relative demand. Typically, a pressure-regulating or pressure reducing valve is interposed between the output of each pump and the system outlet conduit to regulate the system output pressure to a predetermined constant level.

In typical water pressure booster system operation, at least one of the pumps is kept running at all times to maintain building water pressure in distribution piping. Although this method does not require a pressurizing storage tank, energy is wasted by driving the pump during periods of minimal water usage.

It is desirable, therefore, to stop all pumps in the pressure booster system during very low water demand periods, such as during late evening or early morning hours, to conserve energy and to minimize the wear on the pumps and associated control equipment.

Previously various means and devices have been utilized to sense the proper moment to stop and start pump operation. Specifically some of these means and devices are pressure actuated switches, fixed temperature actuated switches, flow actuated switches and combinations thereof. U.S. Pat. No. 3,639,081 describes the prior uses of these various devices and additionally provides one solution to the problem of pump control under minimum flow conditions by monitoring both fluid flow and pressure.

In other prior systems which are commercially available, a fixed temperature actuated switch is utilized. More specifically the fixed temperatures actuated switch monitors the actual temperature of discharging water from the pump volute and stops the pump at a specific temperature. Accordingly, the fixed temperature switch must be set higher than the highest anticipated incoming water temperature to avoid untimely shut down. Since the incoming water temperatures varies throughout the year, the setting of the switch is difficult to determine. Furthermore, the specific temperature setting requires a greater temperature rise to shut-down the pump when the main conduit water is cool than when the water is warmer. Thus, under minimal flow conditions when the conduit water is cool, a fixed temperature switch controlled system may operate the pump for a considerably longer time period than when the conduit water is warm and accordingly energy is wasted.

SUMMARY OF THE INVENTION

In accordance with the principles of the invention, a water pressure booster system includes a control circuit which will control the operation of one or more pressure booster pumps in accordance with the temperature differential between the inlet and outlet of the booster system.

In an illustrative embodiment of the invention a temperature differential switch shuts-down the pump or pumps when the temperature differential between the system inlet and outlet reaches a predetermined value. Further, after the pump or pumps are shut-down by the differential switch, it or they are re-started by a pressure actuated switch connected to the system outlet.

BRIEF DESCRIPTION OF THE DRAWINGS

The invention may be better understood from a reading of the following detailed description in conjunction with the drawings in which like reference numerals designate like items and in which.

DETAILED DESCRIPTION OF THE DRAWINGS

Figure 1:
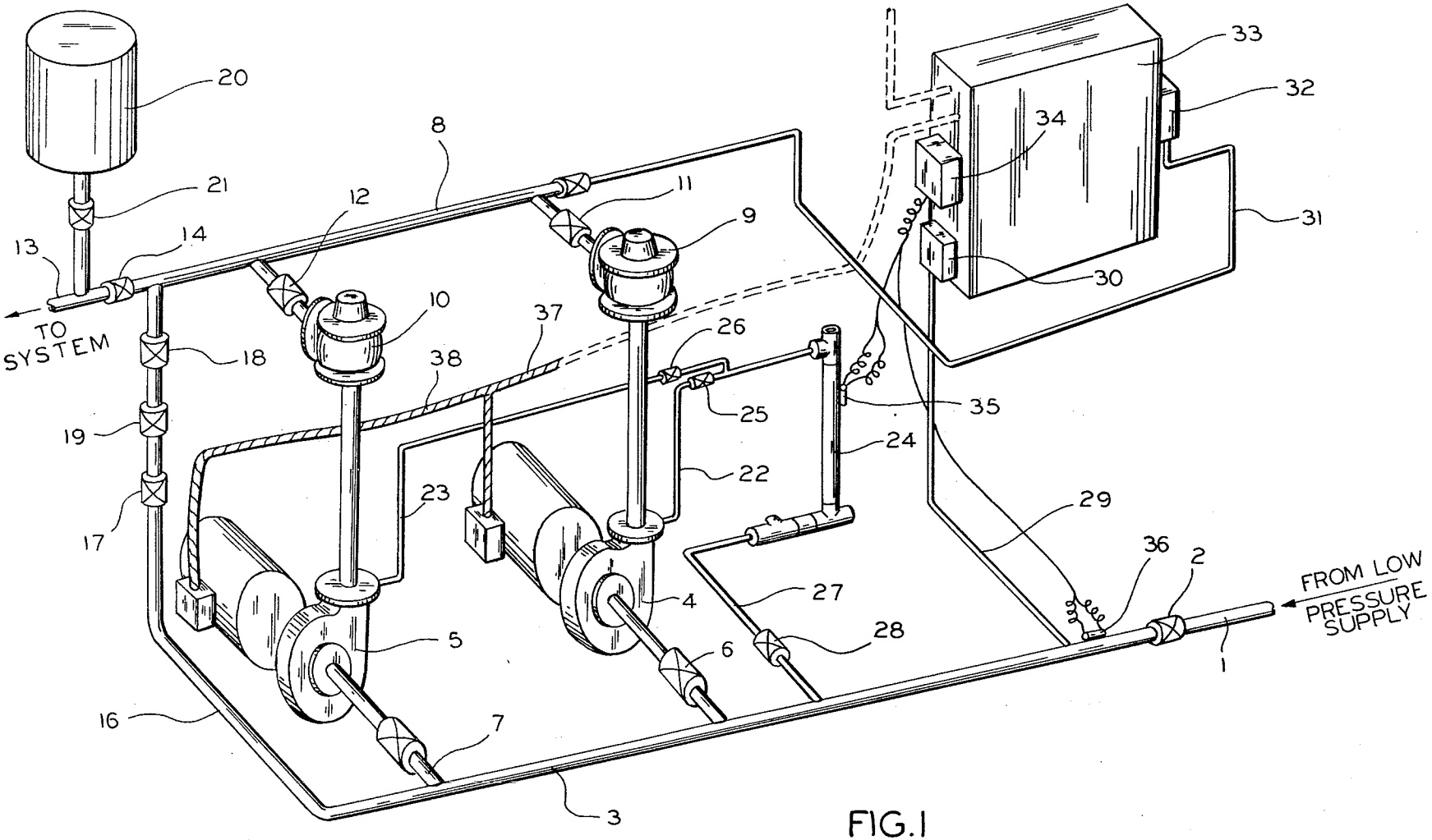
FIG. 1 illustrates in partial pictorial and partial schematic form a system in accordance with the invention.

FIG. 1 illustrates a typical water pressure booster system incorporating the invention. As will be evident to those skilled in the art, although FIG. 1 is directed to an arrangement having pressure pumps, other arrangements having fewer or more pumps may advantageously utilize the concepts of the present invention. Additionally, although a pressure tank is shown, in the illustrative embodiment, the present invention may be advantageously applied to systems which utilize pressure tanks located at points other than the one shown.

Water from a low pressure supply (which is not shown) is coupled to the system via city main 1 via service valve 2. Each of the pumps 4,5 are coupled to a suction header 3 via service valves 6,7. The volute of each pump 4,5 is coupled to a discharge header 8 via a combination pressure reducing and check valve 9,10 and a service valve 11,12. The discharge header 8 is coupled to a system main 13 via a service valve 14. A bypass path 16 is provided from suction header 3 to the system main 13 via a pair of service valves 17, 18 and a check valve 19.

A pressure tank 20 which may be of any conventional type such as a hydro-pnuematic tank commercially available is coupled to the system main 13 via a service valve 21. The actual location of the pressure tank 20 and of the physical connection thereof to the service main 13 may be at any convenient point either adjacent to or remote from the pressure booster system.

Each pump 4,5 has a fluid sensing connection 22, 23 from its discharge to a temperature header 24 via a corresponding service valve 25, 26. The temperature header 24 is connected to the suction header 3 via pipe 27 and service valve 28.

A pressure sensing conduit 29 couples a low pressure suction switch 30 to the suction header 3.

A second pressure sensing conduit 31 couples system pressure switch 32 to discharge header 8.

The pressure switches 30 and 32 are physically mounted on a control panel 33. Not shown in FIG. 1 are the various electrical connections to the control panel.

A differential temperature control 34 is also mounted in the control panel 33. The differential temperature control 34 may be of a type which is commercially available such as a "Delta T" differential temperature thermostat which is manufactured by Heliotrope General of Spring Valley, Calif., or any other similar device which provides a set of switch contacts the operation of which is controlled accordingly to the temperature differential between two sensors.

The differential temperature control is electrically connected to a high temperature sensor 35 which monitors the temperature of the temperature header 24 and to a low temperature sensor 36 which monitors the temperature of the city main 1. The sensor 36 is spaced apart from the connection of pipe 27 to the suction header 3. In this embodiment, the spacing is five feet.

Each of the motors 4,5 is electrically wired to the control panel 33 via electrical conduits 37,38.

The electrical connections of the arrangement will be described with reference to FIG. 2 which shows schematically the circuitry within control panel 33 and the connections to the other various elements of FIG. 1.

Figure 2:
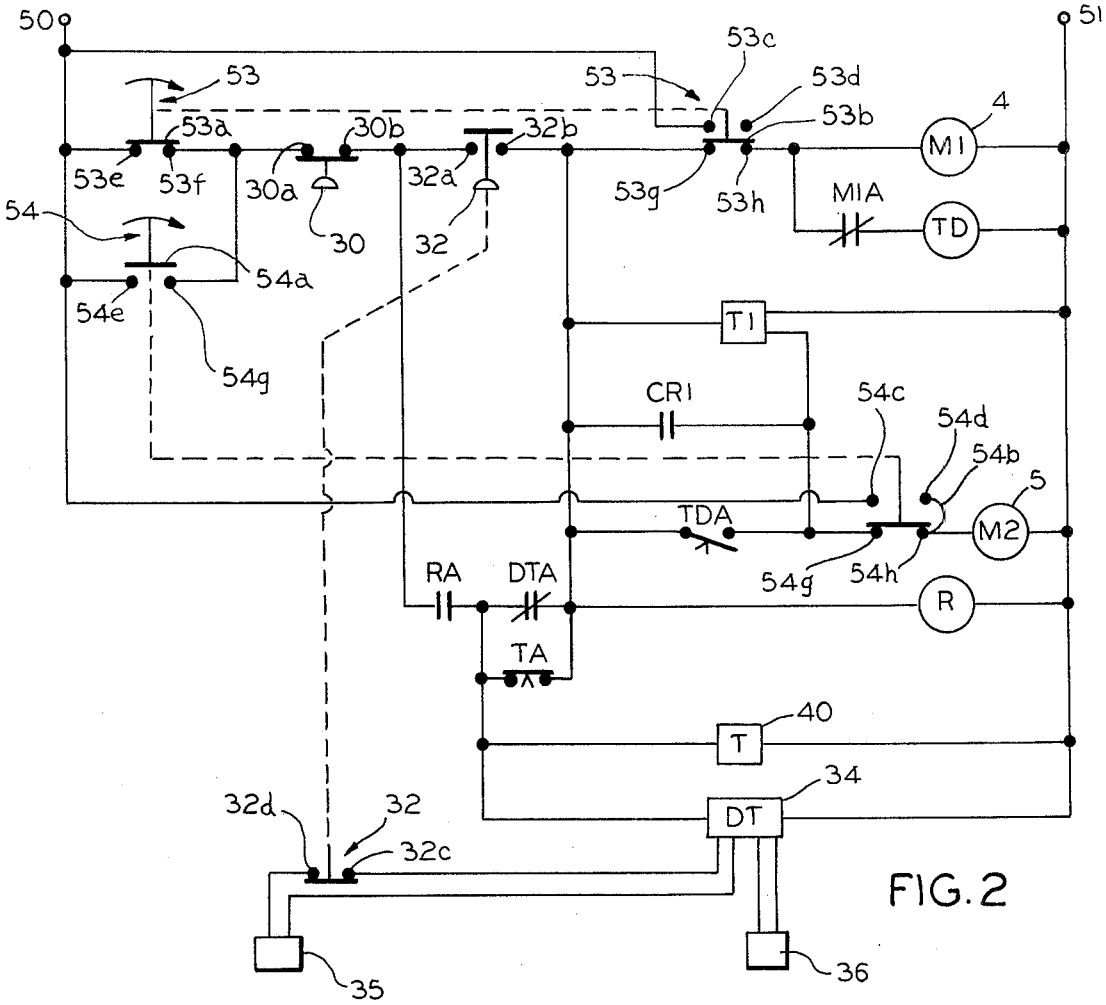
FIG. 2 illustrates the system of FIG. 1 in simplified schematic form.

An ac power source (which is not shown) is coupled to the circuit of FIG. 2 via terminals 50, 51. The overall control of the circuit is effected by a manual control switch 53 which is a double pole three position switch. In the off position poles 53*a* and 53*b* are disconnected from the ac power source. When the switch 53 is placed in the second or manual position pole 53*b* closes contacts 53*c* and 53*d* thereby establishing an ac current path directly to the starter of motor 4. When the switch 53 is in the second position, the remainder of the control circuit is bypassed. When the switch 53 is placed in the third or automatic position as shown in FIG. 2, pole 53*a* closes contacts 53*e* and *f* and pole 53*b* closes contacts 53*g* and 53*h*.

If after switch 53 has been placed in the automatic position, and adequate suction header pressure is available, then the low suction switch 30 will close contacts 30*a* and 30*b*. If adequate suction pressure is not available, the low suction switch 30 will open contacts 30*a* and 30*b* and the motors will not operate until adequate suction header pressure is available. With contacts 30*a* and 30*b* closed the operation of the system is in either one of two modes as determined by the system pressure switch 32.

Pressure switch 32 has two sets of contacts. If the system pressure is below a predetermined cut-in pressure, the contacts 32*a* and 32*b* will be closed and contacts 32*c* and 32*d* will be open. Under this condition a circuit may be traced through switch 53, switch 30 and contacts 32*a* and 32*b* of switch 32 and through switch 53 to the starter of motor 4. Motor 4 will therefore start pumping. Simultaneously, a circuit will be traced from switch contact 32*b* to relay R which will close normally open contacts RA. With contacts RA closed, the differential temperature control 32 is energized. A short time after Motor 4 starts, the system pressure should rise to the cut-out level of pressure switch 32. When pressure switch 32 cuts-out, contacts 32*a* and 32*b* will open and contacts 32*d* and 32*c* will be closed. The motor 4 will remain energized with contacts 32*a* and 32*b* open since contacts 32*a* and 32*b* are connected in short with the series connected contacts RA and DTA. DTA is the normally closed contact of the differential temperature control 34. With contacts 32*c* and 32*d* closed, the high temperature sensor 35 is connected to the differential temperature control 34.

If the system flow increases instead of decreasing, a current relay (which is not shown) associated with motor 4 will sense the current through motor 4 and when the current reaches a set point will close normally open contacts CR1. A switch 54 has connections associated with motor 5 similar to those described for switch 53 relative to motor 4. With contacts CR1 a current path is established to Motor 5 via contacts 54*g* and 54*h*.

If the system flow subsequently decreases, then the current flow to motor 4 will decrease and the current relay will open contacts CR1 thereby deenergizing Motor 5. A timer T1 having internal contacts operates similarly to time delay circuit 40 and its associated contacts TA to prevent short cycling of Motor 5.

If the system flow decreases to a minimum value, the temperature difference sensed by sensors 35 and 36 will rise until a predetermined temperature difference at which point the temperature control 34 will open the contacts DTA thereby opening the current path to the starter of motor M1 and to relay R. Motor 4 thus is deenergized.

To prevent short cycling, a time delay circuit or minimum run timer 40 is connected in shunt with the differential temperature control 34 and has normally closed contact TA in shunt with contact DTA.

It should be noted that the reason for providing the switch contacts 32*d* and 32*c* between sensor 35 and differential temperature control 34 is to cause the control 34 to reset more quickly.

It should be further noted that lead pump failure interlock circuit is provided by normally closed starter contacts M1A, time delay circuit TD and its associated normally open contacts TDA. The lead pump failure interlock circuit will automatically energize pump 5 if pump 4 does energize a predetermined time after power is applied to it.

When pumps 4 and 5 are not running, the system pressure will eventually decrease as demand is made on the system. When the system pressure as sensed by system pressure switch 32 via conduit 31 decreases to the cut in pressure of switch 32 contacts 32*a* and 32*b* will close, contacts 32*d* and 32*c* will open and the cycle repeats.

Figure 3:
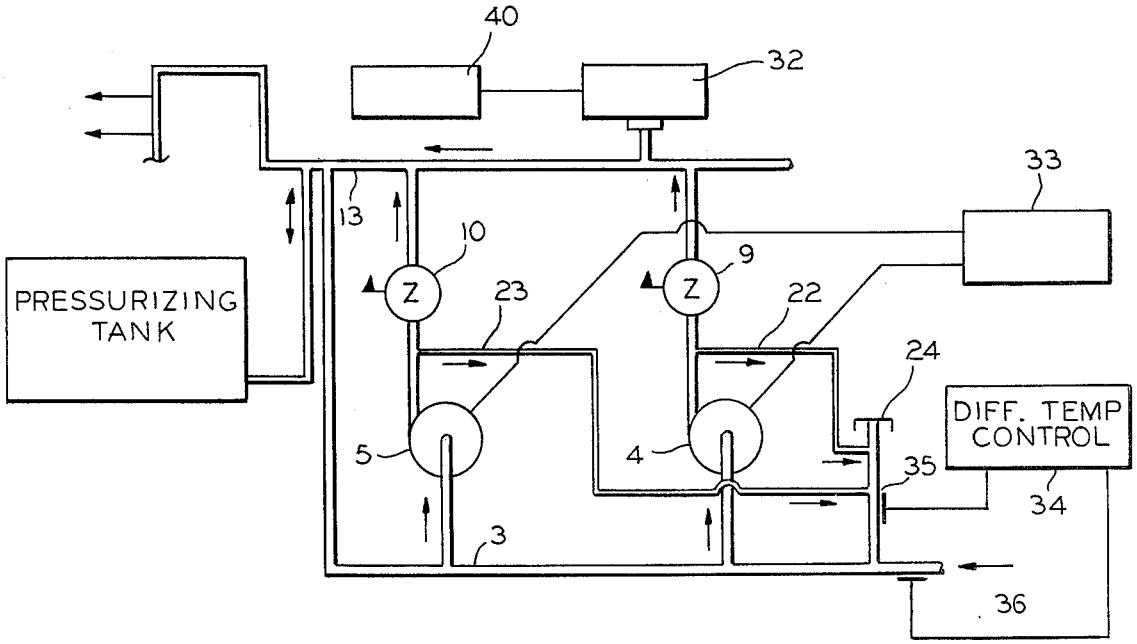
FIG. 3 illustrates the system of FIG. 1 in a more detailed schematic form.

The overall system operations may be more clearly understood with reference to FIG. 3.

When the water demand is moderate, cold water from the city supply main 36 enters the pump suction header 3, flows through one or more of the operating pumps 4,5, through check valves(s) or combination pressure reducing and check valve(s) 9 and into the distribution main 13. A small, metered amount of pumped water is continuously returned from each pump through conduits 23 and 24 into the temperature averaging header 24 and recirculated back into the suction header 3.

When the water flow through the pump volute is moderate, the heat generated in the volute, by virtue of mechanical energy converted to heat energy, is conveyed away by the flowing water, therefore the temperature difference between the incoming and pumped water is very small.

Thus, during moderate demand, the water temperature difference between the inlet and outlet of the pump is very small, hence the temperature difference between the thermal header 24 and water supply main 36 is also correspondingly small. These temperatures are monitored by the differential temperature switch sensors 35 and 36. Because of the small temperature difference between the sensors, the differential temperature switch 34 allows the pump(s) to continue operating.

As the flow through the pump decreases towards zero flow, less and less of the heat is conveyed away thereby causing the water temperature in the volute to rise appreciably. This temperature difference between the pumped and incoming water is utilized to actuate a differential temperature switch which in turn stops the pump.

As the water demand decreases towards zero flow, the temperature of the pumped water begins to rise and the temperature in the thermal header 24 rises accordingly. However, the temperature at sensor 36 is virtually unchanged since it is remotely located from the thermal header 24 and the pumps 4,5. When a sufficient temperature difference develops between sensors 35 and 36, the differential switch 34 is actuated. If the pump(s) had been running previously for the duration set by timer 40, they will stop immediately. However, if the pumps 4,5 had run less than the duration set by the timer 40, they will continue to operate until the set time is logged. This feature prevents undesirable short-cycling of the pumps.

With the pump(s) 4,5 shut-down, the system main 13 pressure is maintained by the storage tank 20 and augmented by compressed gases (air) in distribution piping. The latter alone, in certain installations, is sufficient to maintain pressurization without the tank.

As the water in the system main 13 is withdrawn, the water level in the storage tank 20 recedes causing the gas above it to expand and the consequent drop in pressure. The change in system pressure is sensed by pressure switch 32. When the minimum allowable pressure in the system main is reached, the pressure switch is actuated and starts pump 4 and resets the timer 40 to begin its timing cycle.

After the pump is shut-down by the differential switch, it is re-started by a pressure actuated switch connected to the system main piping. Sensing the pressure in the main, instead of the tank, results in quicker response to system pressure changes. It also allows the pump to start regardless of the water temperature difference.

With the pump 4 running, cold water enters suction header 3, into pump 4 and thermal header 24 thereby decreasing the temperature difference between sensors 35 and 36 which in turn resets the differential switch 34. While the pump is running, the depleted storage tank 20 is replenished and the gas above it re-compressed. The shut-down cycle can now be repeated.

By sensing differential temperature instead of fixed temperature as done previously to determine low flow state through the pump results in a more reliable shut-down because it is not affected by the variable temperature of the incoming water.

Pump shut-down occurs at a lower pump water temperature because the differential temperature switch requires only a few degrees temperature difference between incoming and pumped water for actuation. The lower water temperature assures safety from accidental exposure to hot water discharging from the cold water main.

Furthermore, by utilizing the pressure switch 32, for the starting function only simplifies the setting of the switch 32 since its cut-out point is not of consequence. Additionally, the cut-in (lower) pressure setting is usually less critical than the cut-out (higher) pressure if used for stopping the pump.

It will be apparent to those skilled in the art that various modifications may be made to the illustrative embodiment without departing from the spirit of the invention.

What is claimed is:

1. A water pressure booster system comprising: a suction header in fluid communication with a source of water;

a discharge header in fluid communication with a fluid distribution system;

a least one pressure booster pump having a suction inlet coupled to said suction header and a discharge outlet coupled to said discharge header;

control means for energizing and deenergizing said pump;

said control means comprising a temperature header coupled between said pump discharge outlet and said suction header, first means for sensing the fluid temperature in said temperature header, second means for sensing the temperature of fluid supplied to said suction header, differential temperature control means for generating a first control signal when the temperature differential between said first and second sensing means is a predetermined level, and means responsive to said first signal for de-energizing said pump.

2. A water pressure booster system in accordance with claim 1, wherein said control means comprises pressure sensing means for sensing fluid pressure in said discharge header and for energizing said pump when said pressure is above a predetermined level.

3. A water pressure booster system in accordance with claim 1 or 2 wherein said control means comprises a timing means for maintaining said pump energized for a minimum predetermined time interval.

4. A water pressure booster system in accordance with claim 3, comprising a pressure regulating valve disposed between said discharge outlet and said discharge header.

5. A water pressure booster system in accordance with claim 4 comprising a pressurizing storage tank in fluid communication with said discharge header.

6. A water pressure booster system comprising a suction header in fluid communication with a source of water;

a discharge header in fluid communication with a fluid distribution system;

at least one pressure booster pump having a suction inlet coupled to said suction header, and a discharge outlet coupled to said discharge header;

control means for energizing and de-energizing said pump;

said control means comprising a first means for sensing the temperature of fluid discharged by said pump, a second means for sensing the temperature of fluid supplied to said suction header, and differential temperature control means for deenergizing said motor when the temperature differential between said first and second sensing means exceeds a predetermined level.

7. A water pressure booster system in accordance with claim 6, wherein said control means comprises pressure sensing means for sensing fluid pressure in said discharge header and for energizing said pump when said pressure is above a predetermined level.

8. A water pressure booster system in accordance with claim 7, wherein said control means comprises a timing means for maintaining said pump energized for a minimum predetermined time interval.

9. A water pressure booster system in accordance with claim 8, wherein said first sensing means comprises a temperature header coupled between said pump discharge outlet and said suction header and a temperature sensing element mounted on said temperature header.

10. A water pressure booster system comprising:

a suction header in fluid communication with a source of water;

a discharge header in fluid communication with a distribution system;

a plurality of pressure booster pumps each having a suction inlet coupled to said suction header and a discharge outlet coupled to said discharge header;

control means for selectively energizing and deenergizing said pumps;

said control means comprising a temperature header having an outlet connected to said suction header and an inlet in fluid communication with the discharge outlets of said plurality of pumps, first means for sensing the temperature of fluid in said temperature header, second means for sensing the temperature of fluid supplied to said suction header, and differential temperature control means for deenergizing said plurality of pumps when the temperature differential between said first and second sensing means reaches a predetermined level.

11. A water pressure booster system in accordance with claim 10, wherein said control means comprises pressure sensing means for sensing fluid pressure in said discharge header and for energizing one of said plurality of pumps when said pressure is above a predetermined level.

12. A water pressure booster system in accordance with claim 11, comprising means for energizing another of said plurality of pumps when said one pump reaches a predetermined load capacity.

13. A water pressure booster system in accordance with claim 12, wherein said control means comprises timing means for maintaining each priorly energized pump energized for minimum predetermined time intervals.

* * * * *